US011486044B2

(12) United States Patent
Brouwer et al.

(10) Patent No.: US 11,486,044 B2
(45) Date of Patent: *Nov. 1, 2022

(54) METHOD FOR ZINC PHOSPHATING METAL COMPONENTS IN SERIES SO AS TO FORM LAYERS

(71) Applicant: Henkel AG & Co. KGaA, Duesseldorf (DE)

(72) Inventors: Jan-Willem Brouwer, Willich (DE); Frank-Oliver Pilarek, Bergheim (DE); Fernando Jose Resano Artalejo, Duesseldorf (DE); Jens Kroemer, Neuss (DE); Matthias Hamacher, Huerth (DE); Thibault Leseur, Bruehl (DE); Marc Balzer, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 280 days.

This patent is subject to a terminal disclaimer.

(21) Appl. No.: 16/593,600

(22) Filed: Oct. 4, 2019

(65) Prior Publication Data

US 2020/0032403 A1 Jan. 30, 2020

Related U.S. Application Data

(63) Continuation of application No. PCT/EP2018/055871, filed on Mar. 9, 2018.

(30) Foreign Application Priority Data

Apr. 21, 2017 (EP) ..... 17167478

(51) Int. Cl.
*C23C 22/00* (2006.01)
*C23F 11/18* (2006.01)
*C23C 22/36* (2006.01)

(52) U.S. Cl.
CPC ..... *C23F 11/188* (2013.01); *C23C 22/365* (2013.01)

(58) Field of Classification Search
CPC ..... C23C 22/365; C23C 22/78; C23C 22/362; C23C 22/73
See application file for complete search history.

(56) References Cited

U.S. PATENT DOCUMENTS

| | | | | |
|---|---|---|---|---|
| 6,723,178 | B1 * | 4/2004 | Bannai | C23C 22/13 148/253 |
| 2012/0286909 | A1 | 11/2012 | Ohwaki et al. | |
| 2014/0305803 | A1 | 10/2014 | McMillen et al. | |

FOREIGN PATENT DOCUMENTS

| | | | |
|---|---|---|---|
| CN | 1665957 | A | 9/2005 |
| CN | 101384750 | A | 3/2009 |
| CN | 102027157 | A | 4/2011 |
| CN | 102959127 | A | 3/2013 |
| EP | 1988189 | A1 | 11/2008 |
| EP | 2343399 | A1 | 7/2011 |
| JP | 2006183144 | A | 7/2006 |
| JP | 2006528280 | A | 12/2006 |
| WO | 9839498 | A1 | 9/1998 |
| WO | 0112341 | A1 | 2/2001 |
| WO | 2004007799 | A2 | 1/2004 |
| WO | 2016162422 | A1 | 10/2016 |

OTHER PUBLICATIONS

International Search Report for PCT/EP2018/055871, dated Jun. 7, 2018.
International Search Report for PCT/EP2018/055695, dated Jun. 6, 2018.
EP Search Report for EP 17167478 dated Oct. 20, 2017.

* cited by examiner

*Primary Examiner* — Hai Y Zhang
(74) *Attorney, Agent, or Firm* — Mary K. Cameron

(57) ABSTRACT

The invention relates to a method for zinc phosphating components comprising surfaces made of zinc in order to suppress the formation of insoluble phosphation constituents removably adhered to the zinc surfaces and thus further improve the adhesion of dip-paint coatings applied later. In the method, a process is used of activating the zinc surfaces by means of dispersions containing particulate hopeite, phosphophyllite, scholzite, and/or hureaulite, wherein the proportion of particulate phosphates in the activation process must be adapted to the quantity of free fluoride and dissolved silicon in the zinc phosphation.

18 Claims, No Drawings

METHOD FOR ZINC PHOSPHATING METAL COMPONENTS IN SERIES SO AS TO FORM LAYERS

The present invention relates to a method for zinc phosphating components comprising zinc surfaces in order to suppress the formation of insoluble phosphating constituents loosely adhering to the zinc surfaces, and thus further improving the adhesion of subsequently applied dip coatings. In the method, activation of the zinc surfaces by means of dispersions containing particulate hopeite, phosphophyllite, scholzite and/or hureaulite is used, the proportion of particulate phosphates in the activation having to be adapted to the amount of free fluoride and dissolved silicon in the zinc phosphating.

In the prior art, zinc phosphating is initiated by activating the metal surfaces of the component to be phosphated. The wet-chemical activation is carried out by bringing into contact with colloidal dispersions of phosphates, which, insofar as they are immobilized on the metal surface, are used in the subsequent phosphating as a growth nucleus for the formation of a crystalline coating. Suitable dispersions are colloidal, mostly alkaline aqueous compositions based on phosphate crystallites, which have only small crystallographic deviations in their crystal structure from the type of zinc phosphate layer to be deposited. In addition to the titanium phosphate commonly referred to in the literature as Jernstedt salt, water-insoluble bi- and trivalent phosphates are also suitable as starting materials for providing a colloidal solution suitable for activating a metal surface for the zinc phosphating. In this connection, WO 98/39498 A1 for example teaches in particular bi- and trivalent phosphates of the metals Zn, Fe, Mn, Ni, Co, Ca and Al, in which phosphates of the metal zinc are technically preferably used for activation for subsequent zinc phosphating.

Each type of activation has unique characteristics with respect to the phosphating to be carried out in the subsequent step, which becomes particularly significant in the treatment of components composed of a mix of different metal materials. Closed crystalline zinc phosphate coatings cannot be formed on steel surfaces of components activated with Jernstedt salts if, in the zinc phosphating bath, the proportion of dissolved aluminum exceeds a specific threshold value, for example in the case of components with a high aluminum content, and therefore activation according to WO 98/39498 A1 should be avoided. Such activation also brings about the advantage that thinner and more corrosion-resistant phosphate coatings are achieved on the aluminum surfaces in comparison with activation with Jernstedt salts. Activation with bi- and trivalent phosphates, however, in zinc phosphating baths in which layer-forming aluminum surfaces are also intended to be treated, often gives rise to defective coatings on the zinc surfaces, which are characterized in that loose adhesions of constituents of the zinc phosphate coating can be seen, which significantly reduce the coating adhesion on the zinc surfaces in the following dip-coating. In addition, the loose adhesions consisting of phosphates are partly carried over into a dip coating following the zinc phosphating, where they are in turn partly dissolved in the aqueous binder dispersion. The dissolved phosphates introduced by carrying over into the dip coating can adversely affect the deposition characteristics of the dispersed coating components and can also reduce the effective concentration of essential catalysts/cross-linking agents based on selected heavy metals by precipitation reactions. Carrying over phosphates can thus be the cause of increased baking temperatures, in particular for dipping coatings which contain water-soluble salts of yttrium and/or bismuth in addition to the dispersed resin.

The object of the invention is therefore a method for zinc phosphating metal components which also tolerates high proportions of dissolved aluminum, and therefore involves activation based on a colloidal solution of bi- and/or trivalent phosphates, in order to find suitable conditions for which zinc phosphate coatings that are largely defect-free and free of loose adhesions are achieved on the zinc surfaces, such that excellent coating adhesion results overall. In particular, a method is to be provided in which metal components can be treated in a layer-forming manner in the phosphating stage, the components having both zinc surfaces and aluminum surfaces and preferably also steel surfaces.

This object is surprisingly achieved by adapting the proportion of particulate phosphates contributing to the activation to the amount of free fluoride and silicon in the zinc phosphating.

The present invention therefore relates to a method for the anti-corrosion treatment of a series of metal components comprising metal components that have, at least in part, zinc surfaces, in which method the metal components of the series successively undergo the following wet-chemical treatment steps:

(I) activation by bringing into contact with an alkaline aqueous dispersion that has a D50 value of less than 3 μm and the inorganic particulate constituent of which comprises phosphates, the entirety of these phosphates being composed at least in part of hopeite, phosphophyllite, scholzite and/or hureaulite;

(II) zinc phosphating by bringing into contact with an acidic aqueous composition containing
  (a) 5-50 g/l of phosphate ions,
  (b) 0.3-3 g/l of zinc ions, and
  (c) at least one source of free fluoride, wherein the quotient of the concentration of the phosphates in the inorganic particulate constituent of the alkaline aqueous dispersion of the activation in mmol/kg, based on $PO_4$, with respect to the sum of the concentration of free fluoride and the concentration of silicon in each case in the acidic aqueous composition of the zinc phosphating and in each case in mmol/kg is greater than 0.5.

The components treated according to the present invention can be three-dimensional structures of any shape and design that originate from a manufacturing process, in particular also including semi-finished products such as strips, metal sheets, rods, pipes, etc., and composite structures assembled from said semi-finished products, the semi-finished products preferably being interconnected by means of adhesion, welding and/or flanging to form composite structures. Within the meaning of the present invention, a component is metal if at least 10% of its geometric surface is formed by metal surfaces.

When reference is made in the context of the present invention to the treatment of components having zinc, iron or aluminum surfaces, all the surfaces of metal substrates or metal coatings that contain more than 50 at. % of the relevant element are included. For example, according to the invention, galvanized steel grades form zinc surfaces, whereas at the cutting edges and cylindrical grinding points of, for example, an automobile body, which is made solely of galvanized steel, surfaces of iron can be exposed according to the invention. According to the invention, the components of the series which have zinc surfaces at least in part preferably have at least 5% zinc surfaces with respect to the component surface area. Steel grades such as hot-formed steel may also be provided with a metal coating of aluminum and silicon several microns thick as protection against scaling and as a shaping aid. A steel material coated in this way, has an aluminum surface in the context of the present invention, even though the base material is steel.

Anti-corrosion treatment of the components in series is when a large number of components are brought into contact with the treatment solution provided in the respective treatment steps and conventionally stored in system tanks, the individual components being contacted successively and thus at separate times. In this case, the system tank is the container in which the pretreatment solution is located for the purpose of anti-corrosion treatment in series.

The treatment steps of activation and zinc phosphating for a component of the anti-corrosion treatment in series are carried out "successively", unless they are interrupted by any treatment other than the subsequent wet chemical treatment intended in each case.

Wet-chemical treatment steps within the meaning of the present invention are treatment steps which take place by bringing the metal component into contact with a composition consisting substantially of water, and do not represent rinsing steps. A rinsing step is used exclusively for the complete or partial removal of soluble residues, particles and active components that are carried over by adhering to the component from a previous wet-chemical treatment step, from the component to be treated, without metal-element-based or semi-metal-element-based active components, which are already consumed merely by bringing the metal surfaces of the component into contact with the rinsing liquid, being contained in the rinsing liquid itself. The rinsing liquid can thus be merely city water.

The "pH" as used in the context of the present invention corresponds to the negative common logarithm of the hydronium ion activity at 20° C. and can be determined by means of pH-sensitive glass electrodes. Accordingly, a composition is acidic if its pH is below 7, and alkaline if its pH is above 7.

In the method according to the invention, the individual treatment steps of activation and zinc phosphating are coordinated in such a way that closed coatings are formed on the zinc surfaces of the metal components as part of the zinc phosphating, on which coatings no fine-particle constituents of the zinc phosphate coating are deposited. Accordingly, coatings are available in the subsequent dip coating which adhere very well to the zinc surfaces treated according to the invention. In a preferred embodiment of the method according to the invention, the quotient of the concentration of the phosphates contained in the inorganic particulate constituent of the alkaline aqueous dispersion of the activation is, in mmol/kg, based on $PO_4$, with respect to the sum of the concentration of free fluoride and the concentration of silicon, in each case in the acidic aqueous composition of the zinc phosphating and in each case in mmol/kg, greater than 0.6, particularly preferably greater than 0.7. The concentration of free fluoride in the acidic aqueous composition of the zinc phosphating can be determined potentiometrically by means of a fluoride-sensitive measuring electrode at 20° C. in the relevant acidic aqueous composition of the zinc phosphating after calibration with fluoride-containing buffer solutions without pH buffering. The concentration of silicon in the acidic aqueous composition of the zinc phosphating can be determined by means of atomic emission spectrometry (ICP-OES) in the filtrate of a membrane filtration of the acidic aqueous composition which is carried out using a membrane having a nominal pore size of 0.2 μm.

The particulate constituent of the alkaline aqueous dispersion is the solid portion that remains after drying the retentate of an ultrafiltration of a defined partial volume of the alkaline aqueous dispersion having a nominal cutoff limit of 10 kD (NMWC: nominal molecular weight cut off). The ultrafiltration is carried out by adding deionized water ($\kappa<1$ $\mu Scm^{-1}$) until a conductivity of below 10 $pScm^{-1}$ is measured in the filtrate. The inorganic particulate constituent of the alkaline aqueous dispersion is, in turn, that which remains when the particulate constituent obtained from the drying of the ultrafiltration retentate is pyrolyzed in a reaction furnace by supplying a $CO_2$-free oxygen flow at 900° C. without admixture of catalysts or other additives until an infrared sensor provides a signal identical to the $CO_2$-free carrier gas (blank value) in the outlet of the reaction furnace. The phosphates contained in the inorganic particulate constituent are determined as phosphorus content by means of atomic emission spectrometry (ICP-OES) after acid digestion of the constituent with aqueous 10 wt. % $HNO_3$ solution at 25° C. for 15 min, directly from the acid digestion.

For activation it is likewise important for the alkaline aqueous dispersion to have a D50 value of less than 3 μm, otherwise only very high and thus uneconomical proportions of particulate constituents can produce sufficient coating of the metal surfaces with particles that constitute crystallization nuclei for the zinc phosphating. In addition, dispersions of which the particles are on average larger tend to sediment.

In a preferred embodiment of the method according to the invention, the D50 value of the alkaline aqueous dispersion of the activation is therefore less than 2 μm, particularly preferably less than 1 μm, the D90 value being preferably less than 5 μm such that at least 90 vol. % of the particulate constituents contained in the alkaline aqueous composition fall below this value.

The D50 value in this context denotes the volume-average particle diameter which 50 vol. % of the particulate constituents contained in the alkaline aqueous composition do not exceed. The volume-average particle diameter can be determined as the so-called D50 value according to ISO 13320:2009 by means of scattered light analysis according to the Mie theory from volume-weighted cumulative particle size distributions at 20° C. directly in the relevant composition, where spherical particles and a refractive index of the scattering particles of $nD=1.52-i\cdot 0.1$ are assumed.

The active components of the alkaline dispersion, which effectively promote the formation of a closed zinc phosphate coating on the metal surfaces of the component in the subsequent phosphating and in this sense activate the metal surfaces, are composed primarily of phosphates which in turn at least partially comprise hopeite, phosphophyllite, scholzite and/or hureaulite. In this respect, activation is preferred in which the phosphate proportion of the inorganic particulate constituents of the alkaline aqueous dispersion of the activation is at least 30 wt. %, particularly preferably at least 35 wt. %, more particularly preferably at least 40 wt. %, calculated as $PO_4$ and based on the inorganic particulate constituent of the dispersion.

Activation within the meaning of the present invention is thus substantially based on the phosphates contained according to the invention in particulate form, the phosphates being preferably composed at least in part of hopeite, phosphophyllite and/or scholzite, particularly preferably hopeite and/or phosphophyllite and more particularly preferably hopeite. The hopeite, phosphophyllite, scholzite and/or hureaulite phosphates may be dispersed into an aqueous solution as finely ground powders or as powder paste triturated together with a stabilizer in order to provide the alkaline aqueous dispersion. Without taking into account water of crystallization, hopeites stoichiometrically comprise $Zn_3(PO_4)_2$ and the nickel-containing and manganese-containing variants $Zn_2Mn(PO_4)_3$, $Zn_2Ni(PO_4)_3$, whereas phosphophyllite consists of $Zn_2Fe(PO_4)_3$, scholzite consists of $Zn_2Ca(PO_4)_3$ and hureaulite consists of $Mn_3(PO_4)_2$. The existence of the crystalline phases hopeite, phosphophyllite, scholzite and/or hureaulite in the alkaline aqueous dispersion can be demonstrated by means of X-ray diffractometric methods (XRD) after separation of the particulate constituent by means of ultrafiltration with a nominal cutoff limit of 10 kD (NMWC) as described above and drying of the retentate to constant mass at 105° C.

Due to the preference for the presence of phosphates comprising zinc ions and for having a certain crystallinity, methods for the formation of firmly adherent crystalline zinc phosphate coatings are preferred, according to the invention, in which the alkaline aqueous dispersion of the activation contains at least 20 wt. %, preferably at least 30 wt. %, particularly preferably at least 40 wt. % of zinc in the inorganic particulate constituent of the alkaline aqueous dispersion, based on the phosphate content of the inorganic particulate constituent, calculated as $PO_4$.

However, activation within the meaning of the present invention is not intended to be achieved by means of colloidal solutions of titanium phosphates, since otherwise the layer-forming zinc phosphating on surfaces of iron, in particular steel, is not reliably achieved and the advantage of thin phosphate coatings on aluminum that are effective in protecting against corrosion is not achieved. In a preferred embodiment of the method according to the invention, therefore, the proportion of titanium in the inorganic particulate constituent of the alkaline aqueous dispersion of the activation is preferably less than 5 wt. %, particularly preferably less than 1 wt. %, based on the inorganic particulate constituent of the dispersion. In a particularly preferred embodiment, the alkaline aqueous dispersion of the activation contains a total of less than 10 mg/kg, particularly preferably less than 1 mg/kg of titanium.

For sufficient activation of all metal surfaces selected from zinc, aluminum and iron, the proportion of the inorganic particulate constituents comprising phosphates should be adjusted accordingly. For this purpose, it is generally preferred if, in the method according to the invention, the proportion of phosphates in the inorganic particulate constituent, based on the alkaline aqueous dispersion of the activation, is at least 40 mg/kg, preferably at least 80 mg/kg, particularly preferably at least 150 mg/kg, calculated as $PO_4$. For economic reasons and for reproducible coating results, the activation should be carried out with maximally diluted colloidal solutions. It is therefore preferred for the proportion of the phosphates in the inorganic particulate constituent, based on the alkaline aqueous dispersion of the activation, to be less than 0.8 g/kg, particularly preferably less than 0.6 g/kg, more particularly preferably less than 0.4 g/kg, calculated as $PO_4$.

For good activation of components which have zinc surfaces, it is also advantageous for the metal surfaces to be pickled only slightly during activation. The same applies to activation on the surfaces of aluminum and iron. At the same time, the inorganic particulate constituents, in particular the insoluble phosphates, should undergo only a slight degree of corrosion. Accordingly, it is preferred in the method according to the invention for the pH of the alkaline aqueous dispersion in the activation to be greater than 8, particularly preferably greater than 9, but preferably less than 12, particularly preferably less than 11.

The second zinc phosphating treatment step immediately follows the activation with or without an intermediate rinsing step, such that each component of the series successively undergoes the activation followed by the zinc phosphating without an intermediate wet-chemical treatment step. In a preferred embodiment of the method according to the invention, neither a rinsing nor a drying step takes place between the activation and the zinc phosphating for the components of the series. A "drying step" within the meaning of the present invention denotes a process in which the surfaces of the metal component that have a wet film are intended to be dried with the aid of technical measures, for example by supplying thermal energy or passing a stream of air thereover.

The zinc phosphating is achieved, provided that the coordination with the activation according to the invention has been carried out, generally using conventional phosphating baths that contain (a) 5-50 g/kg, preferably 10-25 g/kg, of phosphate ions,
(b) 0.3-3 g/kg, preferably 0.8-2 g/kg, of zinc ions, and
(c) at least one source of free fluoride.

In an embodiment that is preferred for environmental hygiene reasons, in total less than 10 ppm of nickel and/or cobalt ions are contained in the acidic aqueous composition of the zinc phosphating.

According to the invention, the amount of phosphate ions comprises the orthophosphoric acid and the anions of the salts of orthophosphoric acid dissolved in water, calculated as $PO_4$.

The preferred pH of the acidic aqueous composition of the zinc phosphating in the method according to the invention is above 2.5, particularly preferably above 2.7, but preferably below 3.5, particularly preferably below 3.3. The proportion of the free acid in points in the acidic aqueous composition of the zinc phosphating is preferably at least 0.4, but preferably not more than 3, particularly preferably not more than 2. The proportion of free acid in points is determined by diluting 10 ml sample volume of the acidic aqueous composition to 50 ml and titrating with 0.1 N sodium hydroxide solution to a pH of 3.6. The consumption of ml of sodium hydroxide solution indicates the point number of the free acid.

In a preferred embodiment of the method according to the invention, the acidic aqueous composition of the zinc phosphating additionally contains cations of the metals manganese, calcium and/or iron.

The conventional additivation of the zinc phosphating can also be carried out in an analogous manner according to the invention such that the acidic aqueous composition can contain the conventional accelerants such as hydrogen peroxide, nitrite, hydroxylamine, nitroguanidine and/or N-methylmorpholine N-oxide.

A source of free fluoride ions is essential for the process of layer-forming zinc phosphating on all metal surfaces of the component, which are selected from zinc, iron and/or aluminum surfaces. If all surfaces of the metal materials of the components treated as part of the series are to be provided with a phosphate coating, the amount of the particulate constituents in the activation must be adapted to the amount of free fluoride required for layer formation in the zinc phosphating. If, in addition to the zinc surfaces, the surfaces of iron, in particular steel, are provided with a closed and defect-free phosphate coating, it is preferred in the method according to the invention for the amount of free fluoride in the acidic aqueous composition to be at least 0.5 mmol/kg. In addition, if surfaces of aluminum are also to be provided with a closed phosphate coating, it is preferred in the method according to the invention for the amount of free fluoride in the acidic aqueous composition to be at least 2 mmol/kg. The concentration of free fluoride should not exceed values above which the phosphate coatings predominantly have adhesions that can be easily wiped off, since these adhesions cannot be avoided even by a disproportionately increased amount of particulate phosphates in the alkaline aqueous dispersion of the activation. Therefore, it is also advantageous for economic reasons, if, in the method according to the invention, the concentration of free fluoride in the acidic aqueous composition of the zinc phosphating is below 8 mmol/kg.

The amount of free fluoride can be determined potentiometrically by means of a fluoride-sensitive measuring electrode at 20° C. in the relevant acidic aqueous composition, after calibration with fluoride-containing buffer solutions without pH buffering. Suitable sources of free fluoride are hydrofluoric acid and the water-soluble salts thereof, such as ammonium bifluoride and sodium fluoride, as well as complex fluorides of the elements Zr, Ti and/or Si, in particular complex fluorides of the element Si. In a preferred embodiment of the method according to the invention, the source of free fluoride is therefore selected from hydrofluoric acid and the water-soluble salts thereof and/or complex fluorides of the elements Zr, Ti and/or Si. Salts of hydrofluoric acid are water-soluble within the meaning of the present invention if their solubility in deionized water (□<1 $\mu Scm^{-1}$) at 60° C. is at least 1 g/L, calculated as F.

In order to suppress what is known as "pin-holing" on the zinc surfaces of the component, it is preferred according to the invention for the source of free fluoride to be at least partly selected from complex fluorides of the element Si, in particular from hexafluorosilicic acid and the salts thereof. The term pin-holing is understood by a person skilled in the art of phosphating to mean the phenomenon of local deposition of amorphous, white zinc phosphate in an otherwise crystalline phosphate layer on the treated zinc surfaces or on the treated galvanized or alloy-galvanized steel surfaces. Pin-holing is caused in this case by a locally increased pickling rate of the substrate. Such point defects in the phosphating can be the starting point for corrosive delamination of subsequently applied organic coating systems, and therefore the occurrence of pin-holes should be largely avoided in practice. In this context, it is preferred for the concentration of silicon in water-dissolved form in the acidic aqueous composition of the zinc phosphating to be at least 0.5 mmol/kg, particularly preferably at least 1 mmol/kg, but is preferably less than 6 mmol/kg, particularly preferably less than 5 mmol/kg, more particularly preferably less than 4.5 mmol/kg. The upper limits for the concentration of silicon are preferred because above these values Phosphate coatings are favored that have predominantly those loose adhesions that cannot be avoided even by a disproportionately increased amount of particulate phosphates in the alkaline aqueous dispersion of the activation. The concentration of silicon in the acidic aqueous composition in water-dissolved form can be determined by means of atomic emission spectrometry (ICP-OES) in the filtrate of a membrane filtration of the acidic aqueous composition that is carried out using a membrane having a nominal pore size of 0.2 μm.

Another advantage of the method according to the invention is that, in the course of said method, closed zinc phosphate coatings are also formed on surfaces of aluminum.

Consequently, the series of components to be treated in the method according to the invention preferably also includes the treatment of components which have at least one surface of aluminum. It is irrelevant whether the zinc and aluminum surfaces are realized in a component composed of corresponding materials or in different components of the series.

In the method according to the invention, a good coating primer for a subsequent dip coating, in the course of which a substantially organic cover layer is applied, is realized. Accordingly, in a preferred embodiment of the method according to the invention, the zinc phosphating, with or without an intermediate rinsing and/or drying step, but preferably with a rinsing step and without a drying step, is followed by dip coating, particularly preferably electrocoating, more particularly preferably cathodic electrocoating.

EXAMPLES

Galvanized steel sheets (HDG) were treated in zinc phosphating baths with different levels of free fluoride after prior activation with dispersions of particulate zinc phosphate, and the appearance of the coatings was evaluated immediately after the zinc phosphating. Table 1 contains an overview of the activation and zinc phosphating compositions and the results of the evaluation of the quality of the coatings. The sheets underwent the following method steps in the sequence indicated:

A) Cleaning and degreasing by spraying at 60° C. for 90 seconds 25 g/L BONDERITE® C-AK 1565 (Henkel AG & Co. KGaA) 2 g/L BONDERITE® C-AD 1270 (Henkel AG & Co. KGaA) Preparing with deionized water (κ<1 $\mu mScm^{-1}$); adjusting the pH to 11.8 with potassium hydroxide solution.

B) Rinsing with deionized water (κ<1 $\mu mScm^{-1}$) at 20° C. for 60 seconds

C) Dip activation at 20° C. for 60 seconds 0.5-3 g/kg contains 8.4 wt. % of zinc in the form of $Zn_3(PO_4)_2*4H_2O$ 200 mg/kg $K_4P_2O_7$ PREPALENE® X (Nihon Parkerizing Co., Ltd.) Preparing with deionized water (κ<1$\mu Scm^{-1}$); adjusting the pH to 10.0 with $H_3PO_4$. The D50 value of the dispersion for activation was 0.25 μm at 20° C., determined on the basis of the static scattered light analysis according to the Mie theory in accordance with ISO 13320:2009 by means of particle analyzer HORIBA LA-950 (Horiba Ltd.) assuming a refractive index of the scattering particles of n=1.52−i·0.1.

D) Zinc phosphating by immersion at 50° C. for 180 seconds

| | |
|---|---|
| 1.1 g/kg | zinc |
| 1.0 g/kg | manganese |
| 1.0 g/kg | nickel |
| 15.7 g/kg | phosphate |
| 2 g/kg | nitrate |

An amount of a source of fluoride was added in accordance with Table 1.

Preparing with demineralized water (κ<1 $\mu Sc\mu m^{-1}$); adjusting the free acid with 10% NaOH free acid: 1.0 point The free acid is determined from 10 ml sample volume diluted to 50 ml with deionized water and subsequent titration with 0.1 N NaOH to pH 3.6, where the consumption of sodium hydroxide solution in milliliters corresponds to the amount of free acid in points. Total acid content: 20 points The total acid content is determined from 10 ml sample volume diluted to 50 ml with deionized water and subsequent titration with 0.1 N NaOH to pH 8.5, where the consumption of sodium hydroxide solution in milliliters corresponds to the total amount of acid in points. Sodium nitrite:

2.0 gas points measured in the azotometer after addition of sulfamic acid

E) Rinsing with deionized water ($\kappa<1$ $\mu Sc\mu m^{-1}$) at 20° C. for 60 seconds F) Drying in ambient air It can be seen from Table 1 that satisfactory phosphate coatings, which thus have no loose adhesions on the galvanized steel, can be achieved by adapting the amount of particulate zinc phosphate in the activation to the amount of free fluoride and the hexafluorosilicic acid in the zinc phosphating. If the amount of particulate zinc phosphate in the activation falls below the value defined by the free fluoride amount and the concentration of silicon, coatings that appear partially dusty (A1-Si-300, A3-Si-600 and A1-F-90) are formed which are completely unsuitable for subsequent dip coating.

TABLE 1

| Example* | Activation $PO_4$/mmolkg$^{-1}$ | Zinc phosphating: Free fluoride#/ mmolkg$^{-1}$ | Zinc phosphating: Source | Zinc phosphating: Layer weight/gm$^{-2}$ | Molar ratio $\frac{[PO4]}{[F]+[Si]}$ ** | Appearance 0: no adhesion 1: hardly any adhesions 2: clearly visible adhesions 3: dusty coating |
|---|---|---|---|---|---|---|
| A1 | 0.45 | 0 | - | 3.1 | - | 0 |
| A4 | 2.68 | 0 | - | 2.0 | - | 0 |
| A1-Si-100 | 0.45 | 0.8 | $H_2SiF_6$ | 3.3 | 0.30 | 2 |
| A2-Si-100 | 0.89 | 0.8 | $H_2SiF_6$ | 2.9 | 0.59 | 0 |
| A2-Si-200 | 0.89 | 1.2 | $H_2SiF_6$ | 2.8 | 0.35 | 2 |
| A3-Si-200 | 1.79 | 1.2 | $H_2SiF_6$ | 2.4 | 0.70 | 0 |
| A1-Si-300 | 0.45 | 1.6 | $H_2SiF_6$ | 3.3 | 0.12 | 3 |
| A1-Si-300 | 1.79 | 1.6 | $H_2SiF_6$ | 2.7 | 0.48 | 2 |
| A1-Si-300 | 2.68 | 1.6 | $H_2SiF_6$ | 2.2 | 0.73 | 0 |
| A3-Si-600 | 1.79 | 2.0 | $H_2SiF_6$ | 3.7 | 0.29 | 3 |
| A3-Si-600 | 2.68 | 2.0 | $H_2SiF_6$ | 3.4 | 0.43 | 1 |
| A1-F-90 | 0.45 | 1.6 | $(NH_4)HF_2$ | 3.5 | 0.29 | 3 |
| A1-F-90 | 0.89 | 1.6 | $(NH_4)HF_2$ | 3.3 | 0.56 | 0 |
| A3-F-180 | 0.89 | 3.2 | $(NH_4)HF_2$ | 3.4 | 0.28 | 2 |
| A3-F-180 | 1.79 | 3.2 | $(NH_4)HF_2$ | 2.9 | 0.57 | 0 |
| A3-F-300 | 0.89 | 4.7 | $(NH_4)HF_2$ | 3.6 | 0.19 | 2 |
| A4-F-300 | 1.79 | 4.7 | $(NH_4)HF_2$ | 3.1 | 0.38 | 2 |
| A3-F-300 | 2.68 | 4.7 | $(NH_4)HF_2$ | 2.8 | 0.57 | 0 |
| A4-F-450 | 2.68 | 7.9 | $(NH_4)HF_2$ | 2.6 | 0.34 | 2 |

*the last digits after the hyphen indicate the amount of the source of free fluoride in mg/kg

#measured with ion meter pMX 3000/ion (Xylem Inc.)

**in square brackets, the concentrations of particulate phosphates in the activation and of free fluoride and silicon in the zinc phosphating

What is claimed is:

1. A method for an anti-corrosion treatment of a series of metal components comprising metal components that have, at least in part, zinc surfaces, in which method the metal components of the series successively undergo the following wet-chemical treatment steps:

(I) activation by contacting the metal components with an alkaline aqueous dispersion that has a D50 value of less than 3 μm and an inorganic particulate constituent of which comprises phosphates composed at least in part of hopeite, phosphophyllite, scholzite and/or hureaulite; the phosphates from the inorganic particulate constituent in the alkaline aqueous dispersion are present in an amount less than 0.8 g/kg calculated as $PO_4$ and based on the dispersion;

(II) zinc phosphating by contacting the metal components from step (I) with an acidic aqueous composition containing:

(a) 5-50 g/kg of phosphate ions, (b) 0.3-3 g/kg of zinc ions, and (c) at least one source of free fluoride, wherein the concentration of free fluoride in the acidic aqueous composition is at least 0.5 mmol/kg, wherein the quotient of the concentration of the phosphates in the inorganic particulate constituent of the alkaline aqueous dispersion of step (I) in mmol/kg with respect to the sum of the concentration of free fluoride and the concentration of silicon in each case in the acidic aqueous composition of step (II), in each case in mmol/kg, is greater than 0.5.

2. The method according to claim 1, wherein the proportion of phosphates, based on the inorganic particulate constituents of the alkaline aqueous dispersion of step (I), is at least 30 wt. %, calculated as $PO_4$.

3. The method according to claim 1, wherein the proportion of zinc in the inorganic particulate constituent of the alkaline aqueous dispersion of step (I) is at least 20 wt. %.

4. The method according to claim 1, wherein the proportion of titanium in the inorganic particulate constituent of the alkaline aqueous dispersion of step (I) is less than 5 wt. %.

5. The method according to claim 1, wherein the amount of phosphates from the inorganic particulate constituent of the alkaline aqueous dispersion of step (I) is at least 40 mg/kg, calculated as $PO_4$ and based on the dispersion.

6. The method according to claim 1, wherein the pH of the alkaline aqueous dispersion of step (I) is greater than 8, but less than 12.

7. The method according to claim 1, wherein, as the source of free fluoride, complex fluorides of the element silicon are contained in the acidic aqueous composition of step (II).

8. The method according to claim 7, wherein the concentration of silicon in water-dissolved form in the acidic aqueous composition of step (II) is at least 0.5 mmol/kg.

9. The method according to claim 1, wherein free acid in the acidic aqueous composition of step (II) is at least 0.4 points.

10. The method according to claim 1, wherein the concentration of free fluoride in the acidic aqueous composition of step (II) is less than 8 mmol/kg.

11. The method according to claim 1 wherein neither a rinsing nor a drying step takes place between the activation step (I) and the zinc phosphating step (II).

12. The method according to claim 1 wherein, in the series of components, components that have at least one aluminum surface are also treated.

13. The method according to claim 1 wherein the zinc phosphating step (II), with or without an intermediate rinsing and/or drying step between step (I) and step (II), is followed by dip coating.

14. The method according to claim 1, wherein (I) in step (I), the alkaline aqueous dispersion comprises an amount of phosphates from the inorganic particulate constituent of at least 150 mg/kg, calculated as $PO_4$ and based on the dispersion; and (II) in the acidic aqueous composition of step (II), the source of free fluoride comprises complex fluorides of the element silicon, with the concentration of silicon in water-dissolved form being at least 1 mmol/kg, but less than 6 mmol/kg.

15. The method according to claim 14, wherein (I) in step (I), the alkaline aqueous dispersion has a pH of greater than 9, but less than 11; has a proportion of phosphates, based on the inorganic particulate constituent of at least 40 wt. %, calculated as $PO_4$; a proportion of zinc in the inorganic particulate constituent of at least 40 wt. %; and a proportion of titanium in the inorganic particulate constituent of less than 1 wt. %; and (II) in step (II), the acidic aqueous composition of step (II) has a concentration of free fluoride of at least 2 mmol/kg, but less than 8 mmol/kg and free acid is at least 0.4 points, but not more than 2 points.

16. The method according to claim 14, wherein after step (II), the metal components are subjected to a rinsing step and no drying step, followed by electrocoating.

17. The method according to claim 1, wherein the amount of phosphates from the inorganic particulate constituent in the alkaline aqueous dispersion is less than 0.4 g/kg calculated as $PO_4$ based on the dispersion.

18. The method according to claim 1, wherein a concentration of silicon in water-dissolved form in the acidic aqueous composition is at least 0.5 mmol/kg.

* * * * *